US008844547B2

(12) United States Patent
Förster et al.

(10) Patent No.: US 8,844,547 B2
(45) Date of Patent: Sep. 30, 2014

(54) WASH ARM ARRANGEMENT FOR A DISHWASHER

(75) Inventors: Sarah Förster, Hamburg (DE); Niklas Olson, Stockholm (SE); Anders Haegermarck, Trangsund (SE)

(73) Assignee: Electrolux Home Products Corporation N.V., Brussels (BE)

( * ) Notice: Subject to any disclaimer, the term of this patent is extended or adjusted under 35 U.S.C. 154(b) by 0 days.

(21) Appl. No.: 13/806,519

(22) PCT Filed: Jun. 17, 2011

(86) PCT No.: PCT/EP2011/060151

§ 371 (c)(1),
(2), (4) Date: Feb. 19, 2013

(87) PCT Pub. No.: WO2011/161021

PCT Pub. Date: Dec. 29, 2011

(65) Prior Publication Data

US 2013/0139860 A1 Jun. 6, 2013

(30) Foreign Application Priority Data

Jun. 22, 2010 (EP) ..... 10006451

(51) Int. Cl.
*A47L 15/22* (2006.01)
*A47L 15/23* (2006.01)
*A47L 15/42* (2006.01)

(52) U.S. Cl.
CPC ..... *A47L 15/4278* (2013.01); *A47L 15/23* (2013.01)
USPC ..... 134/172; 134/56 D; 134/57 D; 134/58 D; 134/179; 134/181; 134/198; 134/200

(58) Field of Classification Search
USPC ..... 134/198
See application file for complete search history.

(56) References Cited

U.S. PATENT DOCUMENTS 1,314,622 A 9/1919 Vaudreuil
3,496,949 A 2/1970 Mercer (Continued)

FOREIGN PATENT DOCUMENTS

JP 7-163505 6/1995
JP 7-250799 10/1995

OTHER PUBLICATIONS

International Search Report for Application No. PCT/EP2011/060151; dated Dec. 28, 2011.

(Continued)

*Primary Examiner* — Joseph L Perrin
*Assistant Examiner* — Levon J Shahinian
(74) *Attorney, Agent, or Firm* — Alston & Bird LLP

(57) ABSTRACT

A wash arm arrangement (100) for a dishwasher is disclosed. The wash arm arrangement comprises a central arm (121) adapted to be rotatably connected with a first liquid supply shaft (123) for providing pressurized liquid during operation of the dishwasher. The central arm has a first nozzle (130) arranged for outputting a jet of liquid during operation thereby providing a first reaction force $F_c$ for rotating the central arm about its axis of rotation in a first direction. The wash arm arrangement further comprises a satellite arm (122) rotatably arranged on a second liquid supply shaft (124) arranged on an outer end of the central arm, the satellite arm having a second nozzle (131) arranged for outputting a jet of liquid during operation thereby providing a second reaction force $F_s$ for rotating the satellite arm about its axis of rotation in a second direction being opposite to the first direction. The first and second nozzles are arranged such that the central arm is controlled to move with a periodically alternating speed due to the first and second reaction forces acting on the central arm wherein the instantaneous value of a resulting momentum $M_{tot}$ for the central arm about its axis alters periodically during operation, comprising a first momentum $M_c$ of the central arm caused by a horizontal reaction force portion $F_{cy}$ of the first reaction force $F_c$, and a second momentum $M_s$ of the central arm, caused by the movement of the satellite arm and comprising a momentum created by a horizontal reaction force portion $F_{sy}$ of the second reaction force $F_s$,.

14 Claims, 3 Drawing Sheets

(56) References Cited

U.S. PATENT DOCUMENTS

| | | | | |
|---|---|---|---|---|
| 5,464,482 | A * | 11/1995 | Michael et al. | 134/25.2 |
| 5,477,874 | A | 12/1995 | Yura et al. | |
| 5,542,443 | A | 8/1996 | Yura et al. | |
| 6,263,888 | B1 * | 7/2001 | Nomura et al. | 134/57 D |

OTHER PUBLICATIONS

European Search Report for Application No. EP 10006451.8; dated Feb. 4, 2011.

* cited by examiner

WASH ARM ARRANGEMENT FOR A DISHWASHER

CROSS REFERENCE TO RELATED APPLICATIONS

This application is a national stage application filed under 35 U.S.C. 371 of International Application No. PCT/EP2011/060151, filed Jun. 17, 2011, which claims priority from European Patent Application No. 10006451.8, filed Jun. 22, 2010, each of which is incorporated by reference herein in its entirety.

TECHNICAL FIELD

The present invention relates to a wash arm arrangement for a dishwasher, and more particularly to a wash arm arrangement comprising a satellite arm arranged on a central arm.

BACKGROUND OF THE INVENTION

Wash arm arrangements comprising a central arm onto which an additional second arm, herein after referred to as a satellite arm, is arranged on an outer portion of the central arm are known. Typically, the central arm is connected to a central shaft which serves as a cleaning liquid and rinsing liquid supply duct arranged for feeding the wash arm arrangement with pressurized cleaning liquid during operation of the dishwasher. The central arm can be positioned either at the bottom, in the middle, or at the ceiling of the dishwasher treatment chamber. The satellite arm is mounted with its center to a second shaft for feeding the satellite arm with cleaning liquid during operation of the dishwasher, which second shaft is arranged on an outer end of the central arm. Nozzles having different spray angles for covering a washing area of the treatment chamber with cleaning liquid and/or for driving the spray arm are typically arranged on the satellite arm and on the central arm. When the cleaning liquid is released during operation a thrust is created moving both arms in circles about their individual axis of rotation.

A wash arm arrangement according to this type of known wash arm arrangements is disclosed in U.S. Pat. No. 5,477,874, in which wash arm arrangement a set of first jetting openings, i.e. nozzles, arranged on a first end portion of a first arm, being the central arm, is arranged for jetting cleaning liquid obliquely along approximately the tangent of its rotation locus, driving the central arm in a clockwise direction, while simultaneously jetting cleaning liquid towards the dishes. Further, a second set of jetting openings arranged on a second arm, being the satellite arm, is arranged for jetting cleaning liquid obliquely along approximately the tangent of its rotation locus, driving the second arm in a counterclockwise direction, while simultaneously jetting cleaning liquid towards the dishes. The second arm is arranged on a second end portion of the first arm. The set of jetting openings arranged on the first arm, and the set of jetting openings arranged on the second arm are further arranged to provide respective reaction forces on their respective sides of the first arm which cause momentum on the first arm that are balanced in the horizontal direction and with respect to their respective distances from the rotation center of the first arm, such that respective momentums on the first arm caused by the jetting from the first and second set of nozzles towards the dishes are balanced. Thereby momentums directed in a direction opposite to the dishes generated on the first arm are balanced, wherein the first and second arm rotate smoothly.

SUMMARY

In view of the above, an objective of the invention is to provide an improved wash arm arrangement. In particular, an objective is to provide a wash arm arrangement which provides improved stability of the rotation during a washing session. A further objective is to provide an increased immunity to external influencing factors like residues of detergents and dirt, which may cause the stability of the rotation of the wash arm arrangement to deteriorate over time. The inventive concept is based on an understanding that by arranging a nozzle of a satellite arm and a nozzle of a central arm in a predetermined manner, their respective reaction forces interact on the central arm such that the central arm is controlled to move with a periodically alternating speed which is advantageous for achieving the objects as described above. The reaction forces depend on several components related to the wash arm arrangement, such as the positioning of the nozzles on the central and satellite arms, the size and angle of the nozzle openings, and the size, length and width of the two arms respectively. Further, the hydraulic system in the dishwasher providing pressure and flow of the wash liquid also needs to be taken into account when calculating the resulting reaction forces for achieving the periodically alternating speed of the central arm. The movement of the central arm with a periodically alternating speed comprises a first phase when the central arm slows down, but without stopping completely, and a second phase when the second arm accelerates to increase speed again before it again slows down. In this way, any residues present inside the wash arm bearing may be forced away from the area of the bearing and out from the wash arm when the central arm accelerates instead of perhaps remain inside the spray arm with the potential risk of clogging the bearing.

According to a first aspect of the present invention, there is provided a wash arm arrangement for a dishwasher comprising a central arm adapted to be rotatably connected with a first liquid supply shaft for providing pressurized liquid during operation of the dishwasher. The central arm has a first nozzle arranged for outputting a jet of liquid during operation thereby providing a first reaction force $F_c$ for rotating the central arm about its axis of rotation in a first direction. The wash arm arrangement further comprises a satellite arm rotatably arranged on a second liquid supply shaft arranged on an outer end of the central arm, the satellite arm having a second nozzle arranged for outputting a jet of liquid during operation thereby providing a second reaction force $F_s$ for rotating the satellite arm about its axis of rotation in a second direction being opposite to the first direction. The first and second nozzles are arranged such that the central arm is controlled to move with a periodically alternating speed due to the first and second reaction forces acting on the central arm wherein the instantaneous value of a resulting momentum $M_{tot}$ for the central arm about its axis of rotation alters periodically during operation. The resulting momentum $M_{tot}$, comprising a first momentum $M_c$ of the central arm caused by a horizontal reaction force portion $F_{cy}$ of the first reaction force $F_c$, and a second momentum $M_s$ of the central arm, caused by the movement of the satellite arm and comprising a momentum created by the horizontal reaction force portion $F_{sy}$ of the second reaction force $F_s$.

Thus, there is provided a wash arm arrangement in which the movement of the central arm is controlled such that the speed of rotation is periodically alternating during operation of the dishwasher. The change in speed combined with the opposite directions of the rotation of the central arm and the satellite arm is advantageous for providing a stable rotation of the wash arm arrangement, in the sense that the risk of the performance of the satellite arm rotation and the central arm rotation being changed in time by external factors is decreased.

According to an embodiment of the wash arm arrangement, it is further arranged such that the first momentum $M_c$ of the central arm is somewhat larger than the second momentum $M_s$ of the central arm, such that the central arm is always kept rotating in the first direction.

Hence, the respective nozzles are arranged such that the amplitudes of the momentum $M_c$ about the axis of rotation for the central arm caused by the first nozzle and the momentum $M_s$ about the axis of rotation for the central arm caused by the movement of the satellite arm are almost equally large, such that when these are oppositely directed the arm slows down to a low rotational speed, but is still rotating in the first direction. With a high acceleration, the central arm then increases its rotational speed up to a maximum value corresponding to the maximum resulting momentum $M_{tot_max}=|M_c|+|M_s|$, which is advantageous as it makes the wash arm arrangement less sensitive to disturbances like cleaning residues or dirt depositing in the bearing arrangement at the first shaft of the central arm. According to an embodiment of the wash arm arrangement, a minimum resulting momentum $M_{tot_min}$ of the resulting momentum $M_{tot}$ is selected to be 5-20% of a maximum resulting momentum $M_{tot_max}$.

According to an embodiment of the wash arm arrangement, it further comprises a balancing portion arranged on an opposite end of the satellite arm with reference to the position of the second nozzle, and/or at the first nozzle on the central arm. By providing the balancing portion, the force caused by the jet of liquid outputted from the first and second nozzle on the satellite arm and the central arm, respectively, can be balanced. This further contributes to a more stable movement of the whole wash arm arrangement.

According to an embodiment of the wash arm arrangement, the balancing portion is arranged on an outer portion of the central arm or satellite arm, which is advantageous as it provides a high leverage on the arm. The weight provides a moment of inertia of the arm, which initially may cause the start up of the rotation of the arm to be slower. However, when the wash arm arrangement is rotating, the weight of the balancing portion contributes to making the system less sensitive to interference, such as e.g. a change in friction of a bearing which is typically arranged in the first shaft.

According to an embodiment of the wash arm arrangement, the balancing portion is a freestanding body made of a material which has a higher density then the material of the central arm or satellite arm, which is advantageous as the balancing portion can be kept at a modest size as compared to a balancing portion having a lower density. With a larger weight, higher forces in the arm may be balanced, and in addition with a high density of the weight the dimensions of the central arm or satellite arm can be kept slim.

According to an embodiment of the wash arm arrangement, the balancing portion is a cavity which is filled with liquid during operation. This is advantageous as the functionality may then easily be integrated in the arm during manufacturing by moulding, which is a common manufacturing technique for plastic wash arms. Further, less material may be used in the wash arm thereby decreasing the weight of the wash arm arrangement. This is advantageous during transport.

According to an embodiment of the wash arm arrangement, the balancing portion is a nozzle. Thus, instead of arranging a weight or a cavity to be filled with water, an additional nozzle may be provided symmetrically on an opposite side of the satellite arm when the satellite arm is rotatably connected with a second shaft at its center. The force created by the jet of liquid from the additional nozzle during operation may be used for balancing the satellite arm. Alternatively the additional nozzle may be arranged at a different radial distance with respect to the first/second shaft then the first/second nozzle. The latter is done while at the same time adjusting the nozzle opening such that the equilibrium of forces at the centre of the satellite arm and central arm is maintained.

According to an embodiment of the wash arm arrangement, any one of the first nozzle and the second nozzle is skewed to provide the reaction force, $F_c$ and $F_s$, respectively.

According to an embodiment of the wash arm arrangement, the first or second nozzle is skewed between 2-20° with respect to the vertical plane of the satellite arm.

According to an embodiment of the wash arm arrangement, the second shaft is arranged at an outer end of the central arm, which is advantageous.

According to a second aspect of the inventive concept there is provided a dishwasher comprising at least one wash arm arrangement according to the present inventive concept.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of the element, device, component, means, step, etc., unless explicitly stated otherwise.

Other objectives, features and advantages of the present invention will appear from the following detailed disclosure, from the attached dependent claims as well as from the drawings.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DETAILED DESCRIPTION OF PREFERRED EMBODIMENTS

Figure 1:
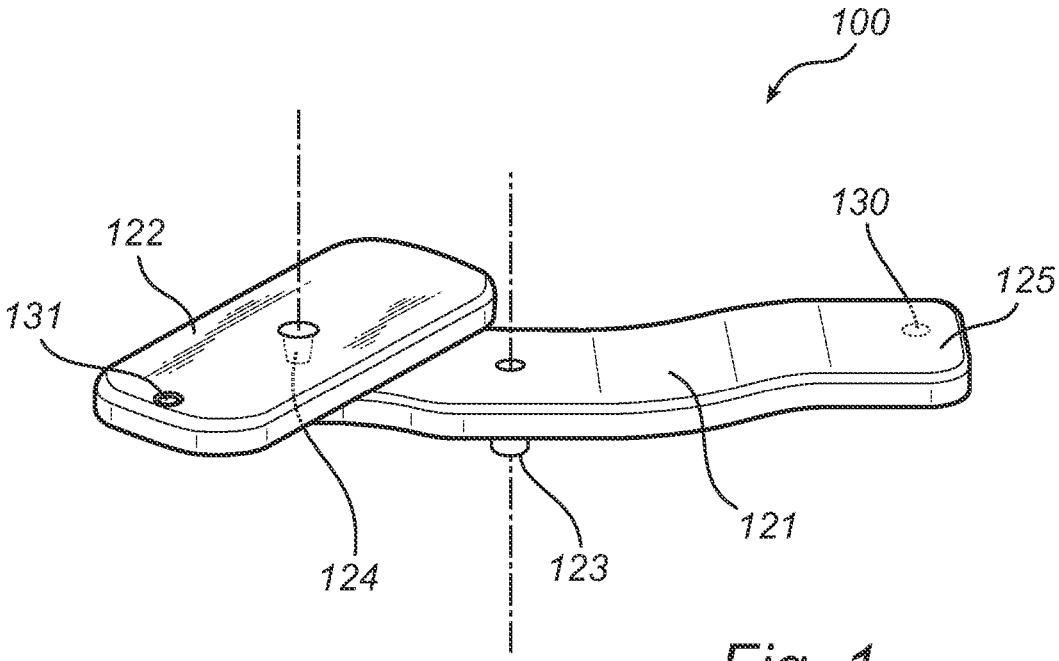
FIG. 1 is a perspective view of an embodiment of a wash arm arrangement according to the invention.

An embodiment of a wash arm arrangement 100 according to the present invention is now described, with reference to FIG. 1. The wash arm arrangement 100 comprises a hollow and elongated central arm 121 with an upper and lower side. At the lower side of the central arm 121, a first shaft alley 123 functioning as a liquid inlet is arranged. The first shaft alley 123 is adapted for rotatable connection with a vertically arranged cleaning liquid supply duct arranged in a treatment chamber of a dishwasher in which the wash arm arrangement is mounted when in operation (not shown). The cleaning liquid supply duct is typically connected to a water supply, a circulation pump and alternatively to a cleaning agent supply, and is further controlled by a control system of the dish washer. The axis of rotation of the central arm 121 is located at the center of the liquid inlet 123. In this embodiment the first shaft 123 is arranged at a portion of the central arm 121 selected substantially at the mass centre of the wash arm arrangement to achieve balance during operation of the dishwasher. The latter is advantageous with respect to avoiding unwanted acoustic resonance and mechanical stress in the shaft alley thereby increasing the lifetime of the mechanical parts.

To continue, the central arm 121 is provided with a liquid outlet arranged at a second shaft alley 124. The liquid outlet exits on the upper side of the central arm 121. The second shaft alley 124 is arranged at an outer end of the central arm 121. Although the second shaft alley 124 here exits on the upper side of the central arm 121 it may alternatively be arranged on the same side as the first shaft alley 123.

At an end portion 125 of the central arm 121 that is opposite to the end portion at which the second shaft alley 124 is arranged, a first nozzle 130 for jetting cleaning liquid during operation of the dish washer is arranged. The first nozzle 130 is arranged such that it exits on the lower side of the central arm 121 and is further arranged to provide a propulsion force for driving the central arm 121 in a clockwise direction. In this exemplifying embodiment, the first nozzle 130 is asymmetrically arranged at the end portion 125, at an edge extending along the side of the central arm.

An elongated satellite arm 122 with an upper and lower surface is rotatably connected at a liquid inlet, arranged in its lower surface, with the second shaft alley 124. The satellite arm 122 is at least partly hollow and receives cleaning liquid via the second shaft 124 during operation. The satellite arm 122 is extending symmetrically in two directions from the second shaft alley 124, about which the satellite arm 122 is arranged to rotate. The axis of rotation of the satellite arm 122 is located at the center of the second shaft 124. At an outer end of the satellite arm 122 a second nozzle 131 is arranged, the second nozzle 131 being in fluid communication with the second shaft alley 124.

During operation cleaning liquid under pressure is distributed to the wash arm arrangement 100 from the dishwasher feeding duct via the first shaft alley 123 and into the central arm 121, from which some cleaning liquid is outputted as a jet from the first nozzle 130. Cleaning liquid is further distributed through the second shaft alley 124 into the satellite arm 122, from which cleaning liquid is subsequently outputted as a jet exiting the second nozzle 131. The second nozzle 131 is arranged to provide a propulsion force directed such that the satellite arm 122 rotates in a counterclockwise direction. That is during operation, the central arm 121 rotates clockwise, as does the centre of the satellite arm 122, which in turn rotates in a counterclockwise direction about the its axis of rotation (at the centre of the satellite arm).

Figure 2:
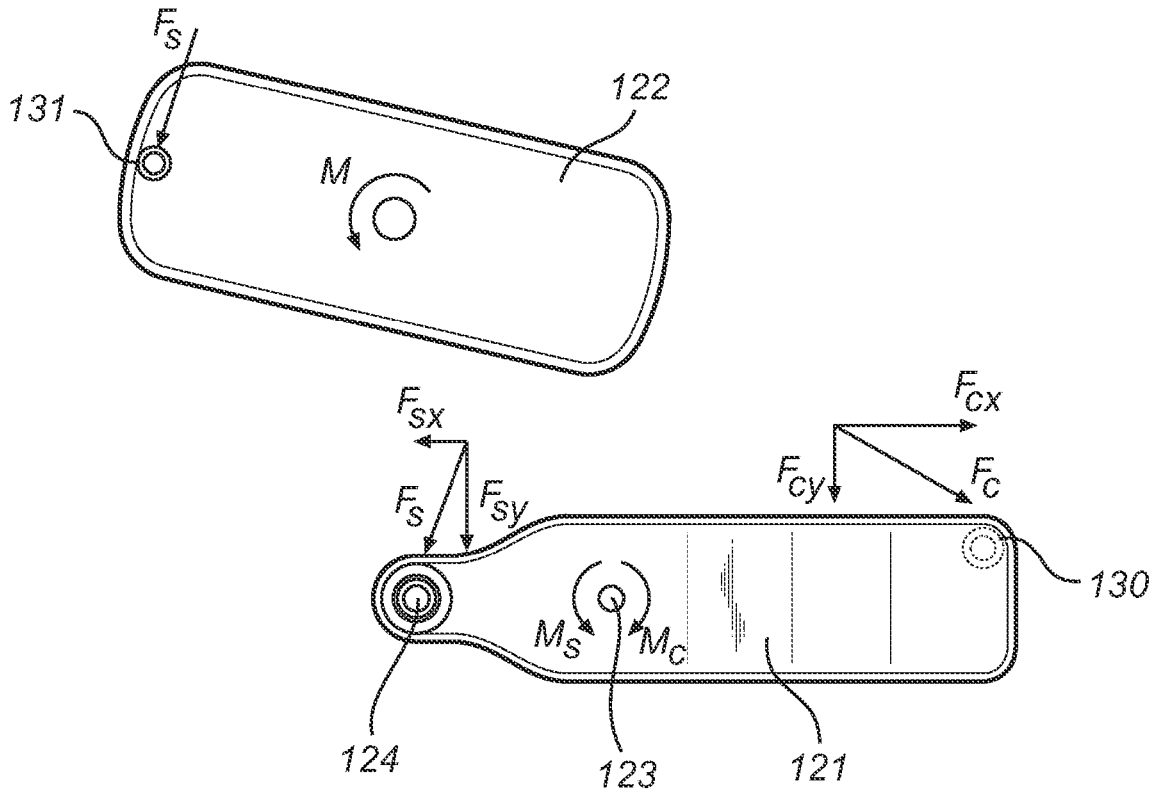
FIG. 2 is a top exploded view of an embodiment of a wash arm arrangement according to the present invention.

As schematically illustrated in FIG. 2, which is an exploded view of the wash arm arrangement 100, the first nozzle 130 on the lower side of the central arm 121 is arranged for outputting a jet of liquid during operation which is inclined with respect to the horizontal plane. The jet from the first nozzle 130 thereby provides a first reaction force $F_c$ of which a horizontal reaction force portion $F_{cy}$ creates a first momentum $M_c$ causing the central arm 121 to rotate about its axis of rotation in a clockwise direction. The second nozzle 131 on the upper side of the satellite arm 122 is also arranged for outputting a jet of liquid during operation. The jet from the second nozzle 131 provides a second reaction force $F_s$ creating a momentum M for rotating the satellite arm 122 about its axis of rotation in a counterclockwise direction. However, the rotation of the satellite arm 122 will also influence the rotation of the central arm 121. The rotation of the satellite arm 121 creates a friction momentum about the second shaft 124 which influences the rotation of the central arm 121. Further, the force $F_s$ is transmitted to the central arm 121 through the second shaft alley 124 by its components $F_{sx}$, which is parallel with the central arm 121, and $F_{sy}$, which is perpendicular to the central arm 121. Component $F_{sy}$, i.e. the horizontal reaction force portion of $F_s$, creates a momentum about the first shaft alley 123 in addition to the friction momentum at the second shaft alley 124 and contributes to a momentum caused by the satellite arm, the second momentum $M_s$. The instantaneous value of the resulting momentum $M_{tot}$ for the central arm 121 about its axis of rotation comprising the first momentum $M_c$ and the second momentum $M_s$ alters periodically during operation, due to the contribution from the horizontal reaction force portion of $F_s$, which component changes in size and sign due to the rotation of the satellite arm 122. Since the horizontal reaction force portion $F_{sy}$ of the second nozzle alternates with the rotation of the satellite arm, its corresponding contribution to the momentum for the central arm will periodically decrease and increase the central arm rotation speed.

Figure 4:
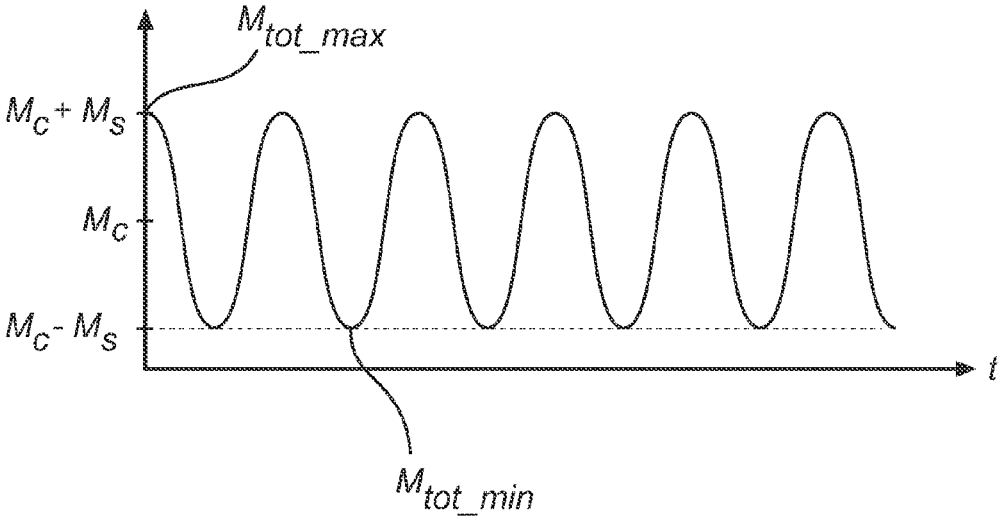
FIG. 4 is a graph illustrating the resulting momentum on the central arm about its axis of rotation versus time.

The periodically alternating resulting momentum $M_{tot}$ is illustrated in FIG. 4. The resulting momentum $M_{tot}$ varies periodically about a value corresponding to the first momentum $M_c$, with an amplitude equal to that of the periodically changing portion of the second momentum $M_s$. A maximum resulting momentum $M_{tot_max}=|M_c|+|M_s|$ arises when $M_c$ and $M_s$ are directed in the same direction, and a minimum resulting momentum $M_{tot_min}=|M_c|+|M_s|$ arises when $M_c$ and $M_s$ are directed in opposite directions, i.e. when the rotating satellite arm is in one of two positions when $F_s$ is parallel with the central arm. When the rotating satellite arm is in a position perpendicular to the central arm, the contribution to the resulting momentum $M_{tot}$ from the horizontal reaction force portion of $F_{sy}$, is zero.

According to an embodiment of the wash arm arrangement, the minimum resulting momentum $M_{tot_min}$ of said resulting momentum $M_{tot}$ is selected to be a predetermined positive value driving the central arm in the first direction at a speed close to zero. That is, the wash arm arrangement is arranged such that the second nozzles size, inclination, and distance from the first shaft alley provides a periodically changing momentum on the central arm about the first shaft alley which has an amplitude that is smaller than but close to the absolute value of the first momentum which is corresponding to the arrangement of the first nozzles size, inclination, and distance from the first shaft alley.

That is, the first momentum $M_c$ of the central arm is somewhat larger than the second momentum $M_s$, such that the central arm is always kept rotating in the first direction, e.g. in a clockwise direction. $M_{tot_min}$ is preferably selected to be 5-20% of a maximum resulting momentum $M_{tot_max}$.

Figure 3:
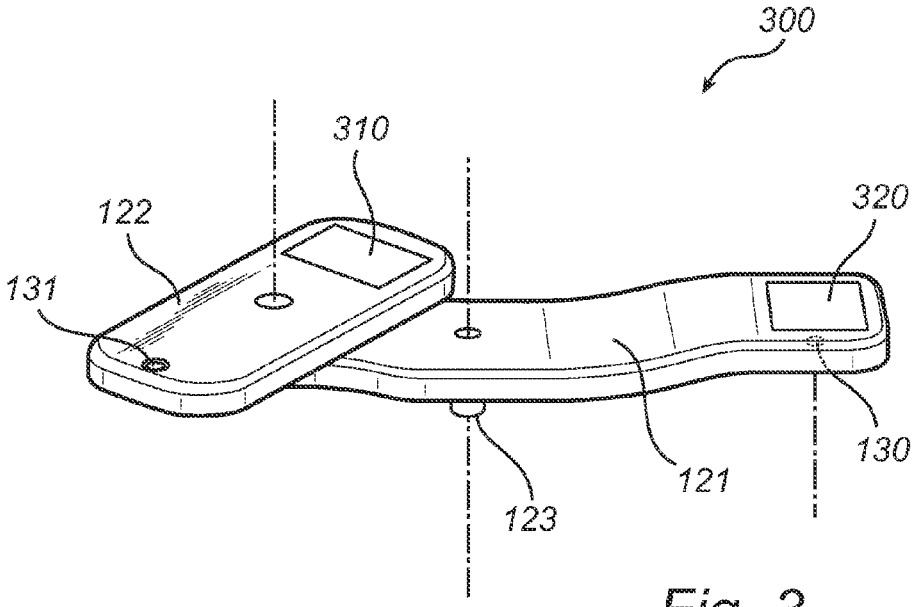
FIG. 3 is a perspective view of an embodiment of a wash arm arrangement according to the invention.

Referring now to FIG. 3, an embodiment of the wash arm arrangement 300, having a principle constitution as described above with reference to FIGS. 1 and 2, is further provided with a first and second weight 310, 320 arranged in the central arm 121 and the satellite arm 122, respectively. The first and second weight 310, 320 are balancing portions, of which one is arranged on an opposite end of the satellite arm 122, the opposite end being defined with reference to the position of the second nozzle 131, and the other is arranged in the central arm at same end portion as the first nozzle 130 is arranged. The balancing portions 310, 320 are arranged at an outer portion of their respective arm, i.e. the satellite arm 122 and the central arm 121.

The first weight 310 is arranged on the satellite arm 122 and is adapted to balance the force created by the jet from the second nozzle 131.

The second weight 320 is arranged on the outer end of the central arm 121 and opposite to the satellite arm 122 on the central arm 121. The second weight 320 is adapted to balance the weight and force from the satellite arm 122.

According to an embodiment of the wash arm arrangement, the balancing portions are selected from a material which has a higher density then the material of the central arm or satellite arm, the material of the wash arm arrangement typically being a plastic or stainless steel. Since the arms are more or less hollow, even the introduction of a balancing portion with a relatively small body with high density made from e.g. brass will have a considerable influence on the balance of the system.

Figure 5:
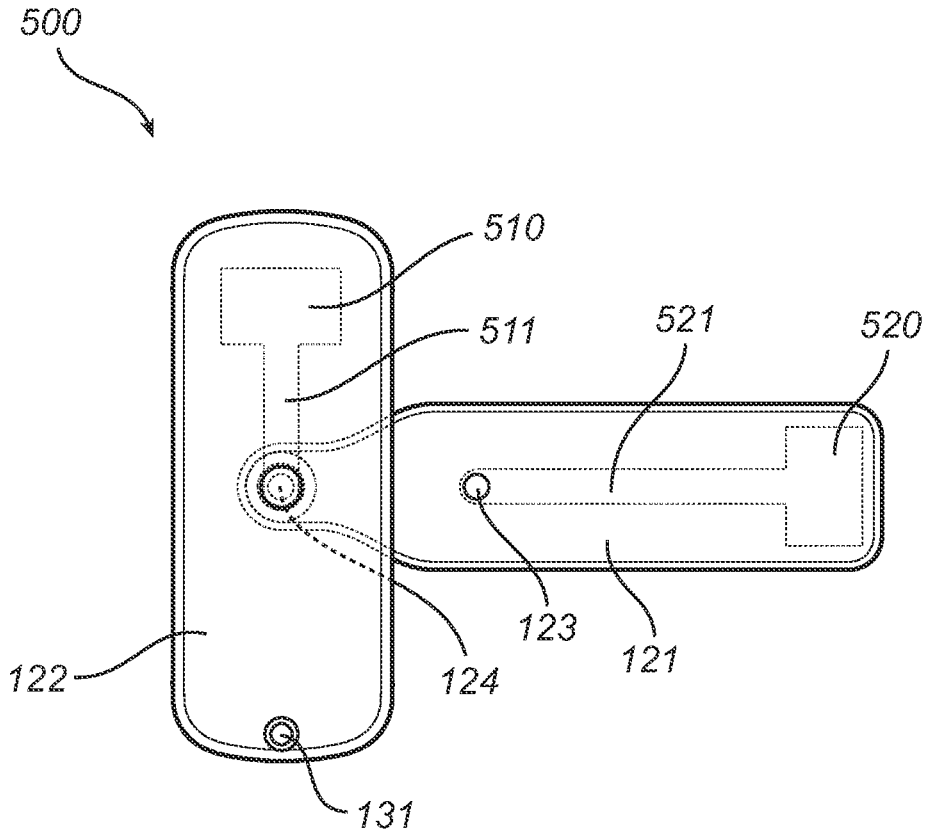
FIG. 5 is a perspective view of an embodiment of a wash arm arrangement according to the invention.

According to an embodiment of the wash arm arrangement 500, and with reference to FIG. 5, balancing portions on the central arm 121 and the satellite arm 122 are arranged as cavities within the arms. A first cavity 510 is arranged inside the satellite arm 122 at an outer portion of the satellite arm being opposite to the second nozzle 131. A liquid supply channel 511 extending from the second shaft alley 124 to the first cavity 510 provides that the first cavity 510 is filled with liquid during operation. In the same manner, a second cavity 520 arranged inside the central arm 121 to balance the force and weight of the satellite arm 122, is filled with liquid during operation via a liquid supply channel 521 extending from the first shaft alley 123 to the second cavity 520.

According to an embodiment of the wash arm arrangement the balancing portion of the satellite arm is an additional nozzle arranged on the opposite side of the satellite arm with respect to the second nozzle (not shown).

According to an embodiment of the wash arm arrangement, the second nozzle 131 is skewed 10° with respect to the vertical plane of the satellite arm 122 and in a direction perpendicular to the extension of the satellite arm 122 such that the outputted jet of liquid is inclined providing the propulsion force such that the satellite arm 22 rotates during operation. To provide a propulsion force from the first nozzle the range of 2-20° for the inclination of the nozzle is applicable. Depending on the application, the first nozzle 130 may be inclined with respect to the vertical plane of the central arm 122 and in a direction perpendicular to the extension of the central arm 121 such that the outputted jet of liquid is inclined and, in addition to providing the propulsion force such that the central arm 121 rotates during operation, the jet reaches a region at half the distance from the first shaft alley of the central arm. This is advantageous for facilitating soil transportation and filter cleaning, e.g. when the wash arm arrangement is arranged at the bottom of the washing compartment of the dishwasher, and when the filter is placed in the middle region of the bottom. To provide a propulsion force from the first nozzle the range of 2-20° for the inclination in of the nozzle is applicable. Above, embodiments of the wash arm arrangement according to the present invention as defined in the appended claims have been described. These should be seen as merely non-limiting examples. As understood by a skilled person, many modifications and alternative embodiments are possible within the scope of the invention.

It is to be noted, that for the purposes of this application, and in particular with regard to the appended claims, the word "comprising" does not exclude other elements or steps, that the word "a" or "an", does not exclude a plurality, which per se will be apparent to a person skilled in the art.

The invention claimed is:

1. Wash arm arrangement for a dishwasher comprising:

a central arm adapted to be rotatably connected with a first liquid supply shaft for providing pressurized liquid during operation of said dishwasher, which central arm has a first nozzle arranged for outputting a jet of liquid during operation thereby providing a first reaction force $F_c$ for rotating said central arm about its axis of rotation in a first direction; and a satellite arm rotatably arranged on a second liquid supply shaft arranged on an outer end of said central arm, said satellite arm having a second nozzle arranged for outputting a jet of liquid during operation thereby providing a second reaction force $F_s$ for rotating said satellite arm about its axis of rotation in a second direction being opposite to said first direction;

a balancing portion of the satellite arm arranged on an opposite side of the axis of rotation of the satellite arm with reference to the position of the second nozzle, wherein the balancing portion is a cavity configured to receive liquid during operation, and configured to allow the liquid to exit the cavity only after operation;

wherein said first and second nozzles are arranged such that said central arm is controlled to move with a periodically alternating speed due to said first and second reaction forces acting on said central arm wherein the instantaneous value of a resulting momentum $M_{tot}$ for said central arm about its axis of rotation alters periodically during operation, said resulting momentum $M_{tot}$ comprising a first momentum $M_c$ of said central arm caused by a horizontal reaction force portion $F_{cy}$ of said first reaction force $F_c$, and a second momentum $M_s$ of said central arm, caused by the movement of said satellite arm and comprising a momentum created by a horizontal reaction force portion $F_{sy}$ of said second reaction force $F_s$.

2. Wash arm arrangement according to claim 1, further arranged such that said first momentum $M_c$ of said central arm is larger than said second momentum $M_s$ of said central arm, such that said central arm is always kept rotating in said first direction.

3. Wash arm arrangement according to claim 2, wherein a minimum resulting momentum $M_{tot_min}$ of said resulting momentum $M_{tot}$ is selected to be 5-20% of a maximum resulting momentum $M_{tot_max}$.

4. Wash arm arrangement according to claim 1, wherein said balancing portion is arranged on an outer portion of said central arm or satellite arm.

5. Wash arm arrangement according to claim 1, wherein any one of said first nozzle and said second nozzle is skewed to provide said reaction force, $F_c$ and $F_s$, respectively.

6. Wash arm arrangement according to claim 5, wherein said first or second nozzle is skewed between 2-20° with respect to a vertical plane of the satellite arm.

7. A dishwasher comprising at least one wash arm arrangement according to claim 1.

8. A dishwasher comprising at least one wash arm arrangement according to claim 1.

9. Wash arm arrangement for a dishwasher comprising:

a central arm adapted to be rotatably connected with a first liquid supply shaft for providing pressurized liquid during operation of said dishwasher, which central arm has a first nozzle arranged for outputting a jet of liquid during operation thereby providing a first reaction force $F_c$, for rotating said central arm about its axis of rotation in a first direction; and a satellite arm rotatably arranged on a second liquid supply shaft arranged on an outer end of said central arm, said satellite arm having a second nozzle arranged for outputting a jet of liquid during operation thereby providing a second reaction force $F_s$ for rotating said satellite arm about its axis of rotation in a second direction being opposite to said first direction;

a first balancing portion of the satellite arm arranged on an opposite side of the axis of rotation of the satellite arm with reference to the position of the second nozzle, wherein the first balancing portion is a cavity configured to receive liquid during operation, and configured to allow the liquid to exit the cavity only after operation;

a second balancing portion arranged within the central arm on the same side of the axis of rotation of the central arm as said first nozzle, wherein the second balancing portion comprises a material which has a higher density than the material of the central arm or the satellite arm;

wherein said first and second nozzles are arranged such that said central arm is controlled to move with a periodically alternating speed due to said first and second reaction forces acting on said central arm wherein the instantaneous value of a resulting momentum $M_{tot}$ for said central arm about its axis of rotation alters periodically during operation, said resulting momentum $M_{tot}$ comprising a first momentum $M_c$ of said central arm caused by a horizontal reaction force portion $F_{cy}$ of said first reaction force $F_c$, and a second momentum $M_s$ of said central arm, caused by the movement of said satellite arm and comprising a momentum created by a horizontal reaction force portion $F_{sy}$ of said second reaction force $F_s$.

10. The wash arm arrangement according to claim 9, further arranged such that said first momentum $M_c$ of said central arm is larger than said second momentum $M_s$ of said central arm, such that said central arm is always kept rotating in said first direction.

11. The wash arm arrangement according to claim 10, wherein a minimum resulting momentum $M_{tot_min}$ of said resulting momentum $M_{tot}$ is selected to be 5-20% of a maximum resulting momentum $M_{tot_max}$.

12. The wash arm arrangement according to claim 9, wherein said first balancing portion is arranged on an outer portion of said central arm or satellite arm.

13. The wash arm arrangement according to claim 9, wherein any one of said first nozzle and said second nozzle is skewed to provide said reaction force, $F_c$ and $F_s$, respectively.

14. The wash arm arrangement according to claim 13, wherein said first or second nozzle is skewed between 2-20° with respect to a vertical plane of the satellite arm.

* * * * *